US008303035B2

(12) United States Patent
Hsiao

(10) Patent No.: US 8,303,035 B2
(45) Date of Patent: Nov. 6, 2012

(54) CHAIR ASSEMBLY WITH A SEAT-ADJUSTING DEVICE

(76) Inventor: Yun-Chien Hsiao, Tainan (TW)

( * ) Notice: Subject to any disclaimer, the term of this patent is extended or adjusted under 35 U.S.C. 154(b) by 251 days.

(21) Appl. No.: 12/889,522

(22) Filed: Sep. 24, 2010

(65) Prior Publication Data

US 2012/0074749 A1 Mar. 29, 2012

(51) Int. Cl.
*A47C 1/00* (2006.01)

(52) U.S. Cl. ..... 297/337

(58) Field of Classification Search ..... 297/337, 297/311, 313, 322
See application file for complete search history.

(56) References Cited

U.S. PATENT DOCUMENTS

| | | | | | |
|---|---|---|---|---|---|
| 83,644 | A * | 11/1868 | Leidecker et al. | ..... | 297/329 |
| 2,028,633 | A * | 1/1936 | Thomas | ..... | 297/322 |
| 2,310,346 | A * | 2/1943 | Bell | ..... | 248/408 |
| 3,203,732 | A * | 8/1965 | Hoffman | ..... | 297/313 |
| 6,095,606 | A * | 8/2000 | Opsvik | ..... | 297/340 |
| 6,328,380 | B1 * | 12/2001 | du Rees | ..... | 297/313 |

* cited by examiner

*Primary Examiner* — Milton Nelson, Jr.
(74) *Attorney, Agent, or Firm* — Alan Kamrath; Kamrath IP Lawfirm, PA

(57) ABSTRACT

A chair assembly has a base frame, a backrest frame, a seat frame and a seat-adjusting device. The backrest frame is mounted on the base frame. The seat frame is connected pivotally to the base frame. The seat-adjusting device is mounted between the base frame and the seat frame and may be manipulated to move the seat bar backward or forward relative to the base frame. Therefore, a distance between the seat frame and the backrest frame may be adjusted to adapt for different users.

7 Claims, 5 Drawing Sheets

CHAIR ASSEMBLY WITH A SEAT-ADJUSTING DEVICE

BACKGROUND OF THE INVENTION

1. Field of the Invention

The present invention relates to a chair assembly, and more particularly to a chair assembly with a seat-adjusting device. A seat of the chair assembly may be moved forward and backward to adapt for different users.

2. Description of Related Art

Chairs are essential furniture commonly used in people's daily lives to provide people with comfort and facilitation when they sit thereon.

A conventional chair has a supporting base, a seat, a backrest and two handrails. The seat is mounted on the supporting base. The backrest is mounted on the supporting base behind the seat. The handrails are mounted oppositely on the seat.

Different users have different statures and sitting positions. A person who has relatively longer legs may need more space between the seat and the backrest so that his/her thighs can be completely supported by the seat. On the contrary, a shorter person needs the seat to be closer to the backrest so that he/she can comfortably lean against the backrest.

However, the distance between the seat and the backrest of conventional chairs cannot be changed to adapt to different users.

To overcome the shortcomings, the present invention provides a chair assembly with chair adjusting functions to mitigate or obviate the aforementioned problems.

SUMMARY OF THE INVENTION

The main objective of the invention is to provide chairs with a seat-adjusting device. A seat of the chair assembly may be moved back and forth to adapt for different users.

A chair assembly in accordance with the present invention comprises a base frame, a backrest frame, a seat frame and a seat-adjusting device. The backrest frame is mounted on the base frame. The seat frame is connected pivotally to the base frame. The seat-adjusting device is mounted between the base frame and the seat frame and may be manipulated to move the seat bar backward or forward relative to the base frame. Therefore, the distance between the seat frame and the backrest frame may be adjusted to adapt for different users.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
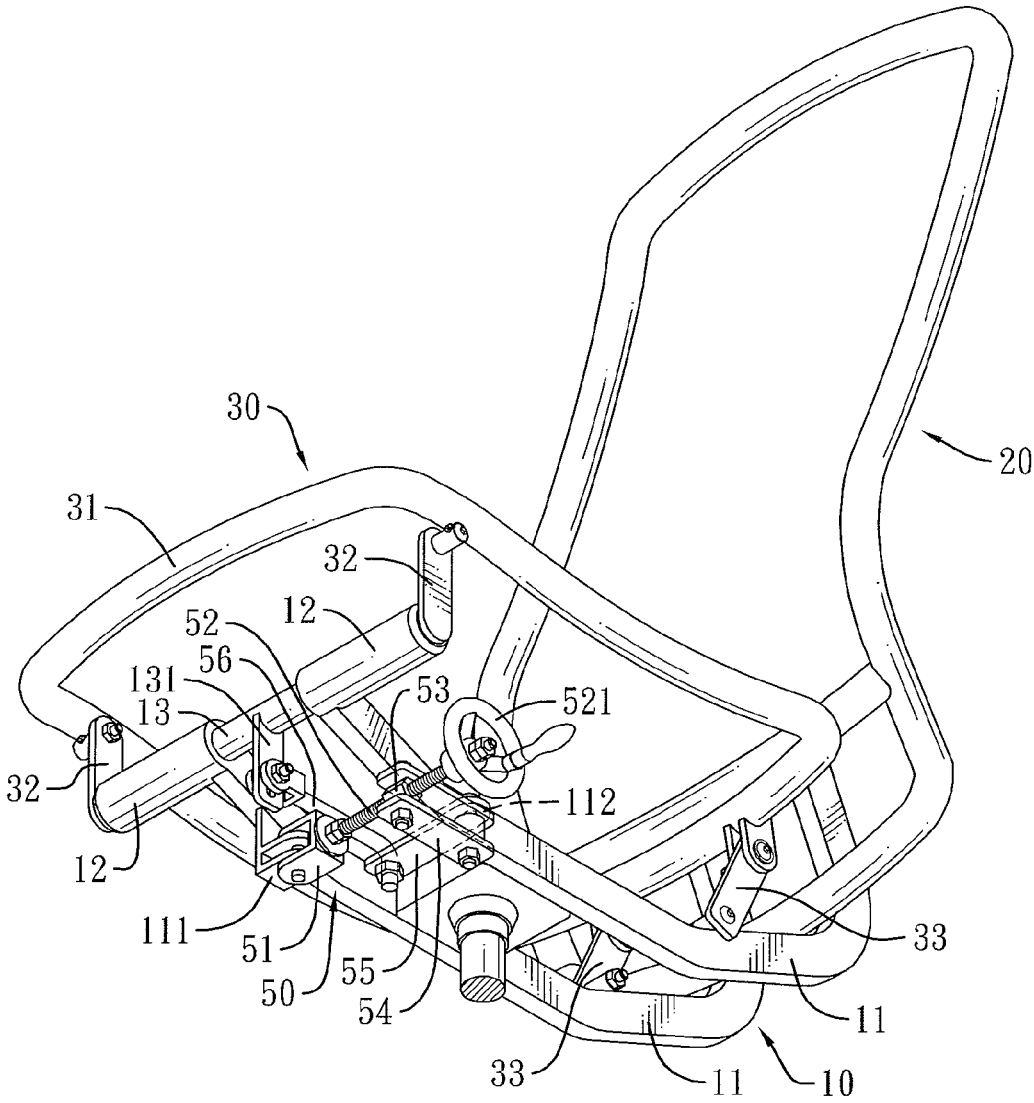
FIG. 1 is a bottom perspective view of a chair assembly with a seat-adjusting device in accordance with the present invention.
Figure 2:
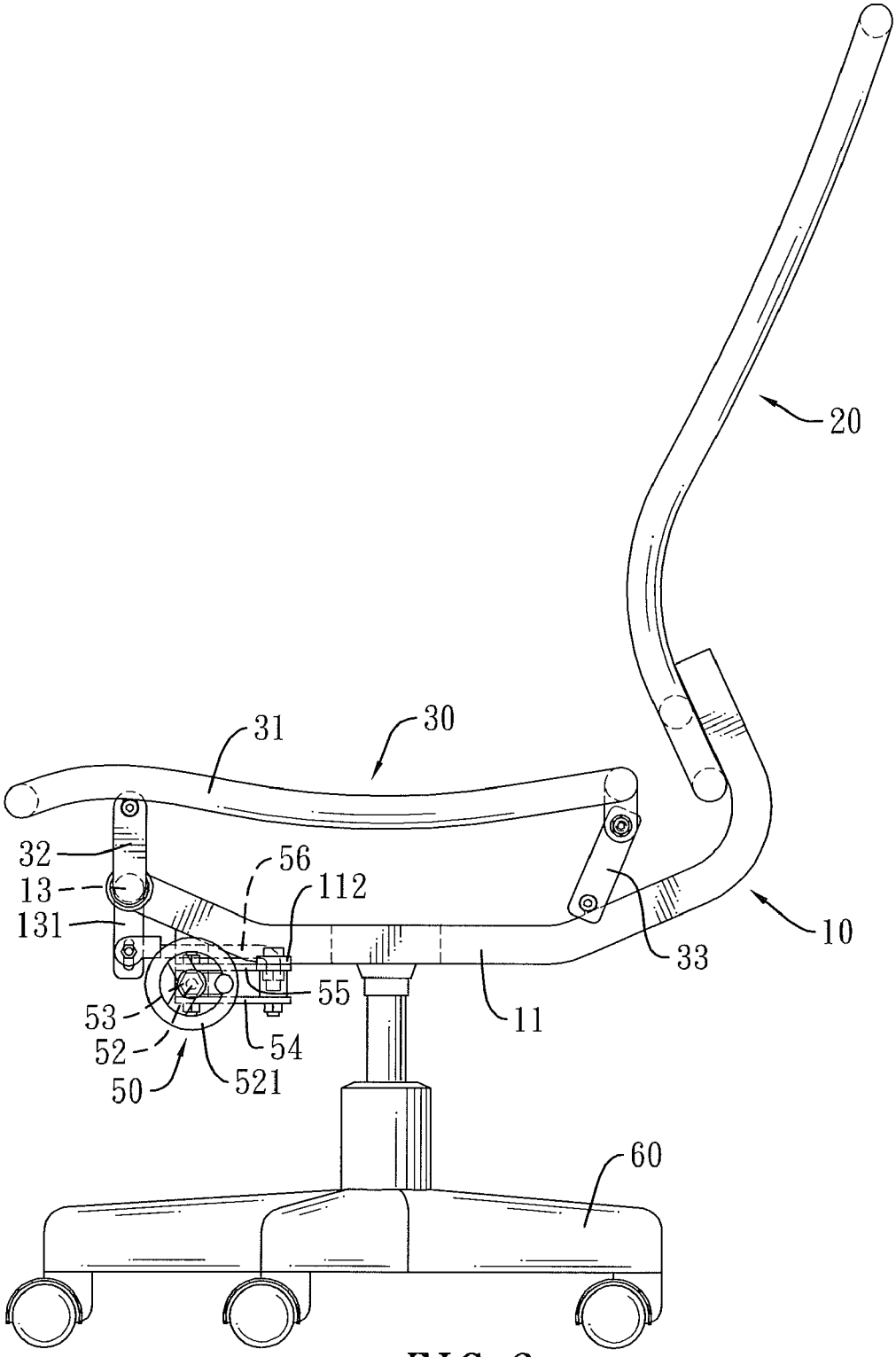
FIG. 2 is a side view of the chair in FIG. 1.
Figure 3:
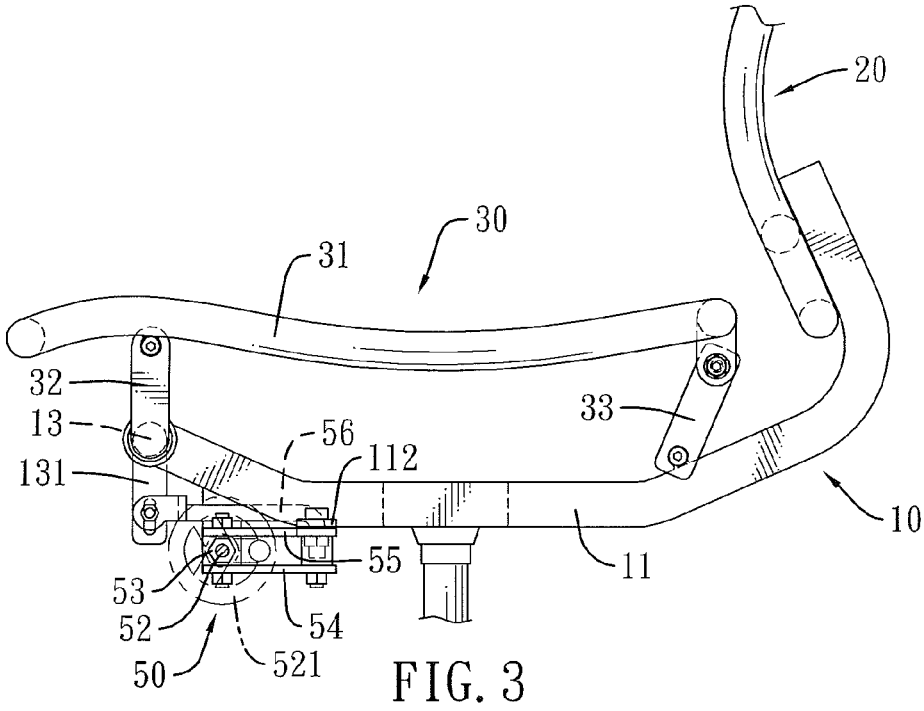
FIG. 3 is a side view of the seat frame, backrest frame and seat-adjusting device of the chair assembly in FIG. 2.
Figure 4:
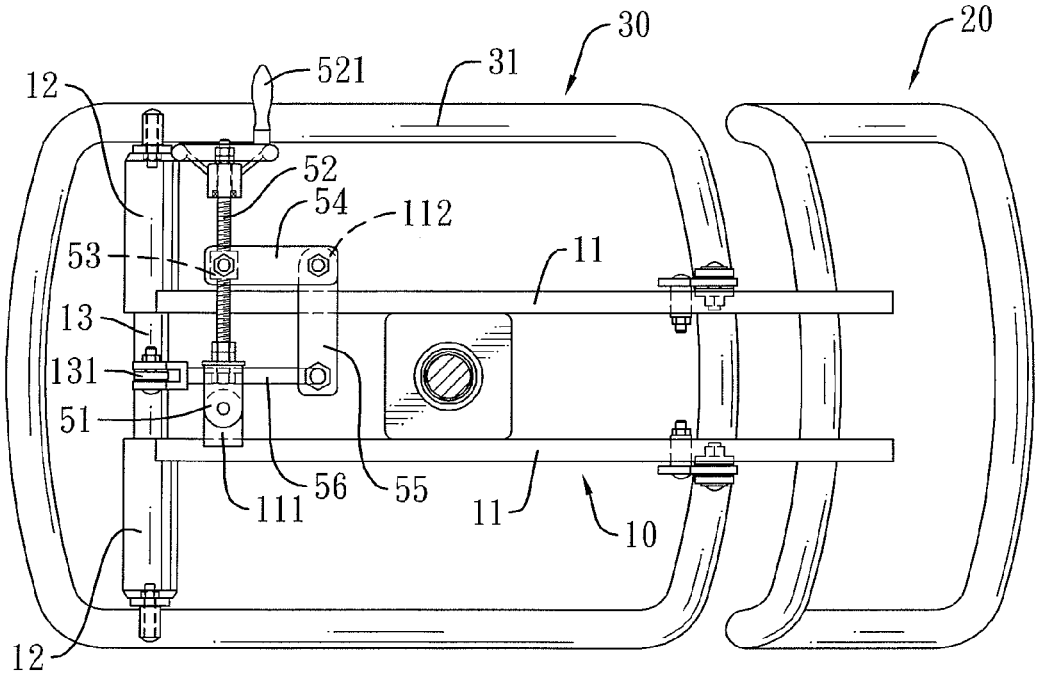
FIG. 4 is a bottom view of the seat frame, backrest frame and seat-adjusting device of the chair assembly in FIG. 3.

With reference to FIGS. 1 to 4, a chair assembly in accordance with the present invention comprises a base frame (10), a backrest frame (20), a seat frame (30), a seat-adjusting device (50) and a supporting leg (60).

The base frame (10) has two mounting bars (11) and a pivot shaft (13).

Each mounting bar (11) has a front end and a rear end and may further have a pivot sleeve (12). The pivot sleeve (12) is formed or mounted on and protrudes transversely from the front end of the mounting bar (11). One of the mounting bars (11) may have a pivot bracket (111) formed on the mounting bar (11). The other mounting bar (11) may have a pivot tab (112) formed on the mounting bar (11).

The pivot shaft (13) is mounted rotatably on front ends of the mounting bars (11). The pivot shaft (13) may be mounted rotatably through the pivot sleeves (12) of the mounting bars (11). The pivot shaft (13) has, two ends and may further have an activating tab (131) formed on and protruding transversely from the pivot shaft (13).

The backrest frame (20) is mounted securely on the mounting bars (11) of the base frame (10).

The seat frame (30) is mounted pivotally on the base frame (10) and has a seat bar (31), two front connecting members (32) and two rear connecting members (33).

The seat bar (31) may be looped and rectangular.

The front connecting members (32) are mounted securely and respectively on the ends of the pivot shaft (13) and are mounted pivotally on the seat bar (31).

The rear connecting members (33) are mounted pivotally and respectively on the mounting bars (11) of the base frame (10) and are mounted pivotally on the seat bar (31).

The seat-adjusting device (50) is mounted between the base frame (10) and the seat frame (30). The seat-adjusting device (50) selectively rotates the pivot shaft (13) to move the seat bar (31) backward or forward relative to the base frame (10) and has a hinge (51), an adjusting bolt (52), a nut (53), a transmission linkage and a driven linkage (56).

The hinge (51) is mounted pivotally on one of the mounting bars (11) of the base frame (10) and may be mounted pivotally on the pivot bracket (111).

The adjusting bolt (52) is mounted rotatably on the hinge (51) and has a connecting end and an adjusting end and may further have a crank handle (521). The connecting end is mounted rotatably on the hinge (51). The adjusting end is defined opposite to the connecting end. The crank handle (521) is mounted securely on the adjusting end so that a user may rotate the adjusting bolt (52) by manipulating the crank handle (521).

The nut (53) is screwed movably around the adjusting bolt (52).

The transmission linkage is mounted pivotally on the nut (53) and is mounted pivotally on the other mounting bar (11) that is opposite to the hinge (51). The transmission linkage may be L-shaped and have a first link (54) and a second link (55). The first link (54) has a first jointing end and a second jointing end. The first jointing end is connected pivotally to the nut (53) and the second jointing end is connected pivotally to the pivot tab (112) on the mounting bar (11). The second link (55) is mounted securely on and protrudes perpendicularly from the first link (54) and has a first linking end and a second linking end. The first linking end is mounted securely on the second jointing end of the first link (54).

The driven linkage (56) has two ends. One end of the driven linkage (56) is connected pivotally to the transmission linkage and may be connected pivotally to the second linking end of the second link (55). The other end of the driven linkage (56) is connected pivotally to the pivot shaft (13) and may be connected loosely and pivotally to the activating tab (131) of the pivot shaft (13) so that the driven linkage (56) is capable of pitching and slightly yawing.

The supporting leg (60) is mounted under the base frame (10) and may have multiple wheels facilitating moving the chair assembly.

Figure 5:
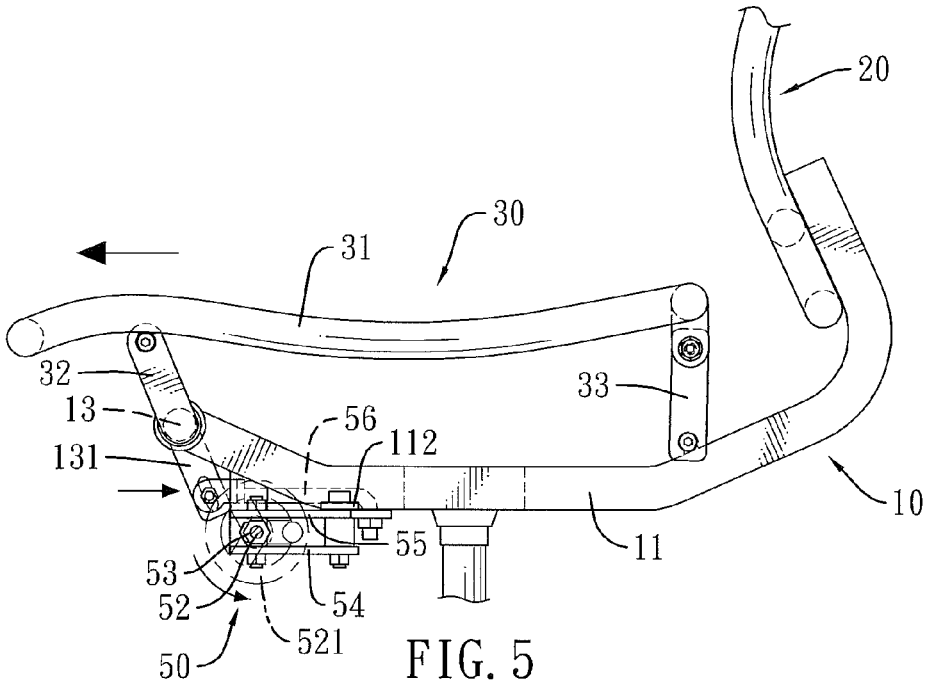
FIG. 5 is an operational side view of the seat frame, backrest frame and seat-adjusting device of the chair assembly in FIG. 3.
Figure 6:
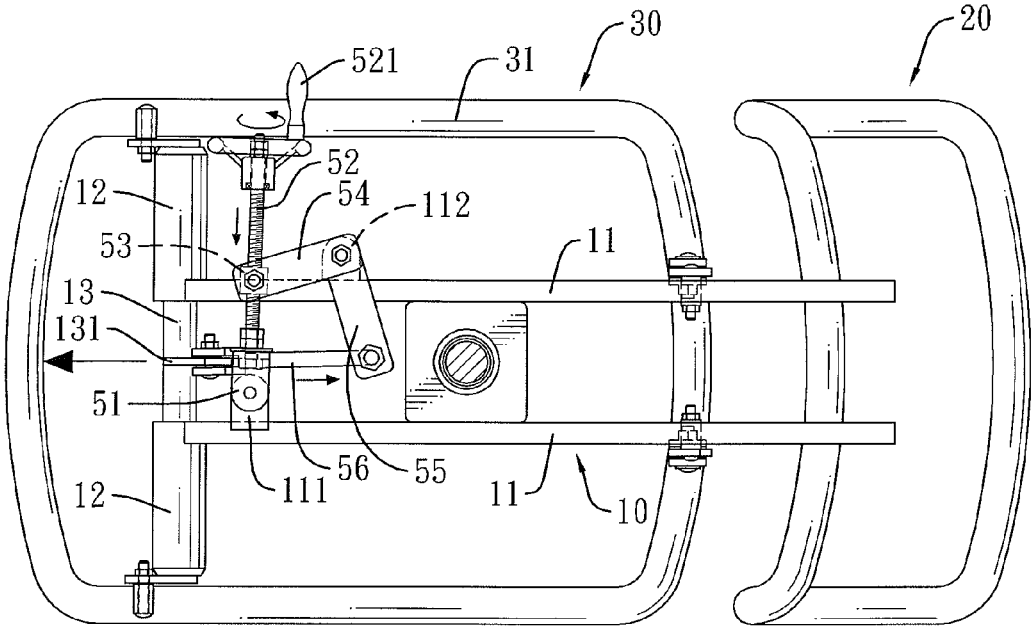
FIG. 6 is an operational side view of the seat frame, backrest frame and seat-adjusting device of the chair assembly in FIG. 4.

With further reference to FIGS. 5 and 6, counterclockwise rotating the crank handle (521) and the adjusting bolt (52) move the driven linkage (56) backward. The driven linkage (56) rotates the pivot shaft (13) and pivots the front connecting member (32) so that the seat bar (31) is moved forward away from the backrest frame (20).

Figure 7:
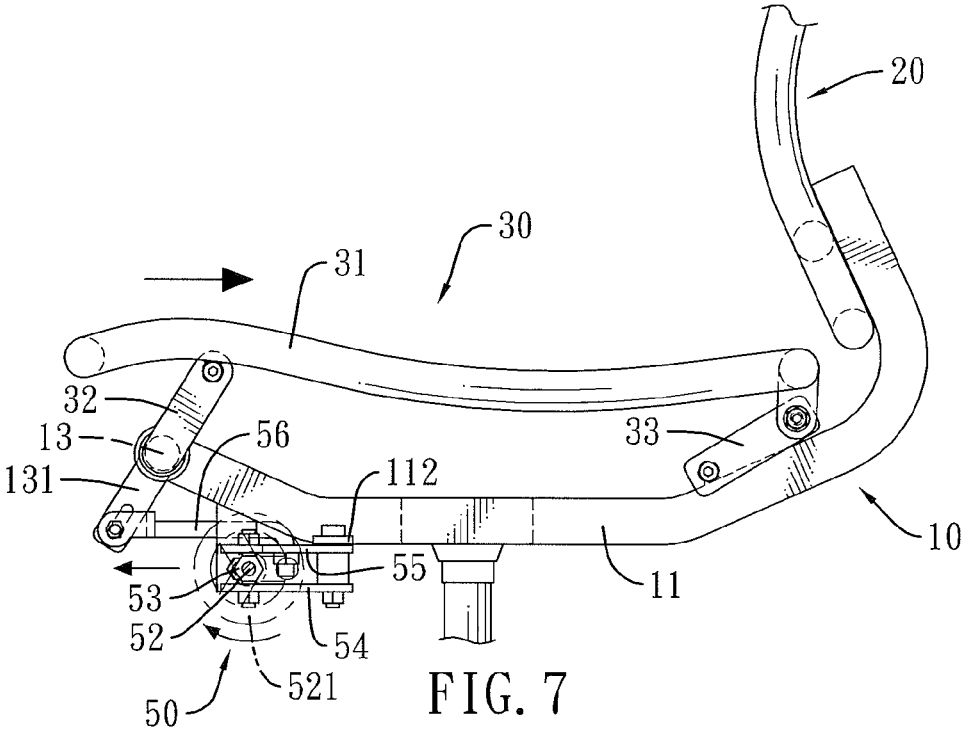
FIG. 7 is another operational side view of the seat frame, backrest frame and seat-adjusting device of the chair assembly in FIG. 3.
Figure 8:
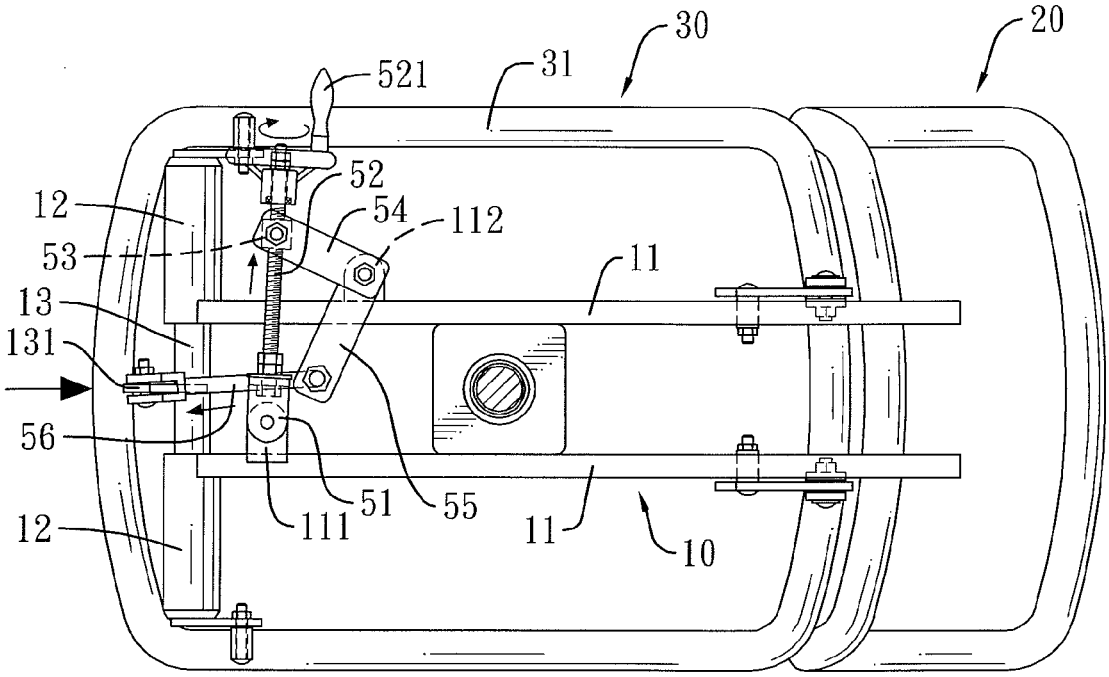
FIG. 8 is another operational side view of the seat frame, backrest frame and seat-adjusting device of the chair assembly in FIG. 4.

With further reference to FIGS. 7 and 8, clockwise rotating the crank handle (521) and the adjusting bolt (52) moves the driven linkage (56) forward. The driven linkage (56) rotates the pivot shaft (13) and pivots the front connecting member (32) so that the seat bar (31) is moved backward toward the backrest frame (20).

The seat-adjusting device (50) allows users to manipulate the crank handle (521) of the adjusting bolt (52) to move the seat bar (31) back and forth. Therefore, a distance between the seat bar (31) and the backrest frame (20) may be adjusted to adapt for different users.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A chair assembly comprising:

a supporting frame having two mounting bars and each mounting bar having a front end and a rear end; and a pivot shaft mounted rotatably on the front ends of the mounting bars and having two ends;

a backrest frame mounted securely on the mounting bars of the base frame;

a seat frame mounted pivotally on the base frame and having a seat bar;

two front connecting members mounted securely and respectively on the ends of the pivot shaft and mounted pivotally on the seat bar; and two rear connecting members mounted pivotally and respectively on the mounting bars of the base frame and mounted pivotally on the seat bar;

a seat-adjusting device mounted between the base frame and the seat frame, selectively rotating the pivot shaft to move the seat bar backward or forward relative to the base frame and having a hinge mounted pivotally on one of the mounting bars of the base frame;

an adjusting bolt mounted rotatably on the hinge and having a connecting end mounted rotatably on the hinge; and an adjusting end defined opposite to the connecting end;

a nut screwed movably around the adjusting bolt;

a transmission linkage mounted pivotally on the nut and mounted pivotally on the other mounting bar that is opposite to the hinge; and a driven linkage having two ends, one end connected pivotally to the transmission linkage and the other end connected pivotally to the pivot shaft.

2. The chair assembly as claimed in claim 1, wherein each mounting bar further has a pivot sleeve protruding transversely from the front end of the mounting bar; and the pivot shaft is mounted rotatably through the pivot sleeves of the mounting bars.

3. The chair assembly as claimed in claim 2, wherein one of the mounting bars further has a pivot bracket formed on the mounting bar; and the hinge is mounted pivotally on the pivot bracket.

4. The chair assembly as claimed in claim 3, wherein one of the mounting bar further has a pivot tab formed on the mounting bar; and the transmission linkage is L-shaped and has a first link having a first jointing end connected pivotally to the nut and a second jointing end connected pivotally to the pivot tab on the mounting bar; and a second link mounted securely on and protruding perpendicularly from the first link and having a first linking end mounted securely on the second jointing end of the first link and a second linking end connected pivotally to one end of the driven linkage.

5. The chair assembly as claimed in claim 4, wherein the pivot shaft further has an activating tab formed on the protruding transversely from the pivot shaft; and the other end of the driven linkage connected loosely and pivotally to the activating tab of the pivot shaft so that the driven linkage is capable of pitching and slightly yawing.

6. The chair assembly as claimed in claim 5, wherein the adjusting bolt further has a crank handle mounted securely on the adjusting end.

7. The chair assembly as claimed in claim 6 further comprising a supporting leg mounted under the base frame.

* * * * *